US011700930B2

(12) United States Patent
Debaecker et al.

(10) Patent No.: US 11,700,930 B2
(45) Date of Patent: Jul. 18, 2023

(54) HINGED APPLICATOR FOR A COSMETIC PRODUCT AND ASSOCIATED PACKAGING AND APPLICATION ASSEMBLY

(71) Applicant: L'OREAL, Paris (FR)

(72) Inventors: Xavier Debaecker, Clichy (FR); Sylvain De Raemy, Clichy (FR)

(73) Assignee: L'OREAL, Paris (FR)

( * ) Notice: Subject to any disclaimer, the term of this patent is extended or adjusted under 35 U.S.C. 154(b) by 1026 days.

(21) Appl. No.: 16/325,985

(22) PCT Filed: Aug. 9, 2017

(86) PCT No.: PCT/EP2017/070136
§ 371 (c)(1),
(2) Date: Feb. 15, 2019

(87) PCT Pub. No.: WO2018/036816
PCT Pub. Date: Mar. 1, 2018

(65) Prior Publication Data

US 2021/0386180 A1 Dec. 16, 2021

(30) Foreign Application Priority Data

Aug. 25, 2016 (FR) ..... 16 57940

(51) Int. Cl.
*A45D 34/04* (2006.01)
*A45D 40/26* (2006.01)
*A46B 5/00* (2006.01)

(52) U.S. Cl.
CPC ..... *A45D 34/045* (2013.01); *A45D 40/265* (2013.01); *A46B 5/0041* (2013.01); *A45D 2200/25* (2013.01)

(58) Field of Classification Search
CPC .... A45D 32/04; A45D 32/042; A45D 32/043; A45D 32/045; A45D 32/046;
(Continued)

(56) References Cited

U.S. PATENT DOCUMENTS 1,369,664 A * 2/1921 Izawa ..... A46B 7/06 15/167.1
2,666,222 A * 1/1954 Gordon ..... A45D 40/28 15/185
4,165,755 A * 8/1979 Cassai ..... A45D 40/265 132/218
4,370,989 A * 2/1983 Taylor ..... A45D 34/042 132/317
(Continued)

FOREIGN PATENT DOCUMENTS

KR 2011 0107224 A 9/2011
KR 20110107224 A * 9/2011

*Primary Examiner* — Jacqueline T Johanas
*Assistant Examiner* — Sarah Woodhouse
(74) *Attorney, Agent, or Firm* — Polsinelli PC

(57) ABSTRACT

This invention relates to a cosmetic product applicator, including: an application member (30) comprising an application element (42); and a gripping member (32) hinged to the application member, with the gripping member being mobile with respect to the application member around an axis of rotation (38), between a first and a second stable configurations. The application member and the gripping member respectively comprise first and second (75) guiding elements, configured to slide against one another during a rotation of the gripping member with respect to the application member, with each one of the first and second stable configurations corresponding to a minimum of elastic stress between said first and second guiding elements, said elastic stress being considered in the radial direction with respect to the axis of rotation (38).

10 Claims, 2 Drawing Sheets

(58) Field of Classification Search
CPC .... A45D 40/26; A45D 40/262; A45D 40/264; A45D 40/265; A45D 40/267; A45D 40/268; A45D 40/28; A45D 2200/00; A45D 2200/25; A45D 2200/10; A45D 34/04; A45D 34/042; A45D 34/043; A45D 34/045; A45D 34/046; A45D 19/02; A46B 5/0041; A46B 5/0083; A46B 5/0091; A46B 2200/1053; A46B 5/002; A46B 5/0054; A46B 5/0058
USPC ..... 132/216, 218, 212, 313, 317, 318; 215/200, 220, 235, 236, 355
See application file for complete search history.

(56) References Cited

U.S. PATENT DOCUMENTS

| | | | | | |
|---|---|---|---|---|---|
| 5,974,618 | A * | 11/1999 | Dumler | A46B 5/0075 | 15/167.1 |
| 7,487,784 | B2 * | 2/2009 | Gueret | A45D 40/267 | 132/218 |
| 8,888,390 | B2 * | 11/2014 | Gueret | A46B 15/0002 | 401/129 |
| 10,130,155 | B2 * | 11/2018 | Ramet | A45D 34/041 | |
| 2004/0009028 | A1 * | 1/2004 | Gueret | A45D 40/265 | 401/122 |
| 2015/0164210 | A1 * | 6/2015 | Lou | A46B 5/0083 | 401/129 |
| 2018/0070701 | A1 * | 3/2018 | Evain | A45D 40/22 | |
| 2019/0208891 | A1 * | 7/2019 | Debaecker | A45D 40/265 | |

* cited by examiner

HINGED APPLICATOR FOR A COSMETIC PRODUCT AND ASSOCIATED PACKAGING AND APPLICATION ASSEMBLY

CROSS REFERENCE TO RELATED APPLICATIONS

This application is a National Phase filing under 35 U.S.C. § 371 of PCT/EP2017/070136 filed on 9 Aug. 2017; and this application claims priority to Application No. 16 57940 filed in France on 25 Aug. 2016. The entire contents of each application are hereby incorporated by reference.

The present invention relates to a cosmetic product applicator, of the type comprising: an application member extending along a first longitudinal axis, a first end of said application member comprising an application element; and a gripping member extending along a second longitudinal axis and hinged to a second end of the application member, with the gripping member being mobile in rotation with respect to the application member about a third axis of rotation, perpendicular to the first and second longitudinal axes, between a first and a second stable configurations.

The term "cosmetic product", refers, according to this invention, to a product as defined in Regulation (EC) N° 1223/2009 of the European Parliament and of the Council of Nov. 30, 2009, on cosmetic products.

The cosmetic product for which the applicator according to the invention is intended is in particular in the form of a powder, a compacted solid, or preferentially a fluid such as a liquid. The product is advantageously a product intended to be placed on the keratin fibers of a user, such as the eyelashes or the eyebrows. The product is for example a makeup product such as a mascara.

In order to benefit from improved ergonomics for applying makeup, it is known to provide applicators of the type cited above, wherein the application member can be oriented in a variable manner with respect to the gripping member. Such a hinged applicator is particularly described in the document EP1369056, held by the Applicant.

For the guiding of the application member, it is known to arrange in the gripping member a slot in which said application member can slide. A width of said slot is optionally variable, in order to create a hard spot to the crossing by said application member. Said gripping and application members are as such maintained with respect to one another in a finite number of predetermined positions.

This type of applicator is however difficult to produce. Indeed, the resistance of the hard spot must be sufficiently low to allow for easy handling for the user, and sufficiently high to prevent an untimely change in position of the application member during use. On the other hand, the slot that forms a hard spot is sensitive to wear and tear due to the substantial friction, which decreases the service life of the applicator. Moreover, this wear and tear can generate the appearance of gaps inside the applicator, which negatively affects the quality perceived by the user.

This invention has for purpose to provide an applicator that is easier to develop, of reliable and sustainable operation and less sensitive to wear and tear by displacement of the gripping and application members in relation to one another.

To this effect, the invention has for object an applicator of the aforementioned type, wherein the application member and the gripping member respectively comprise first and second guiding elements, with said first and second guiding elements being configured to slide against one another during a rotation of the gripping member with respect to the application member, with each one of the first and second stable configurations corresponding to a minimum of elastic stress between said first and second guiding elements, said elastic stress being considered in the radial direction with respect to the axis of rotation.

Thanks to these arrangements, the invention proposes an applicator that is simple to produce, of reliable and sustainable operation and with improved quality as perceived by the user.

In particular, the fact that, during the rotation of the gripping member with respect to the application member, the first and second guiding elements are maintained in sliding contact against one another under the effect of an elastic stress exerted in a radial direction with respect to the axis of rotation of these members makes it possible to offset any existing gaps within the applicator due to the manufacturing tolerances of the various components thereof or which appear within the applicator via wear/matting of the guiding elements over time.

Moreover, according to preferred embodiments of the invention, when the gripping member is angularly located outside of the stable configuration with respect to the application member, the gripping member is in unstable configurations and an elastic stress greater than the minimum reached in stable configurations is exerted between the first and second guiding elements.

In particular, the elastic stress that is exerted between the first and second guiding elements is preferably maximal when the gripping member is angularly located half-way between the first and second stable configurations with respect to the application member.

The term unstable configuration means here that if the gripping member is in an unstable configuration with respect to the application member and no exterior effort is applied to it, then it is elastically recalled to the nearest stable configuration by the elastic stress that exists between the first and second guiding elements.

Thanks to these arrangements, a "sporing effect" is provided within the applicator, of which crossing force or torque can be calibrated by adjusting the maximum elastic stress reached between the stable configurations of the gripping member with respect to the application member.

As such, it can be provided that, using one of the first and second stable configurations, the user has to exert only a slight "flick" on the gripping member, for example a torque of about 0.1 N·m, in order to overcome the elastic stress maximum and reach the other stable configuration of the gripping member with respect to the application member. The elastic stress between the first and second guiding elements opposes this displacement until the maximum elastic stress is reached, then assists this displacement once this maximum is reached and crossed.

According to further advantageous aspects of the invention, the applicator comprises one or several of the following features taken in isolation or in any technically possible combination:

- the gripping member has a tabular shape that defines an inner chamber, with the first and second guiding elements being arranged in said inner chamber;
- the first guiding element of the application member comprises a guide rail, said guide rail being delimited by two studs that are substantially aligned according to a direction parallel to the axis of rotation;
- the second guiding element of the gripping member comprises: a guide pad comprising a sliding surface able to slide against the first guiding element according to a tangential direction, corresponding to a direction of displacement of the gripping member with respect to the application member and a pad support, integral with both said pad and a wall, in particular a side wall, of the inner chamber of the gripping member;

according to the tangential direction, the sliding surface is delimited by a first and a second free edges;

according to the tangential direction, the sliding surface is delimited by a first and a second notches able to snap-lock onto the first guiding element of the application member;

the guide pad and the pad support form a cantilever in the inner chamber of the gripping member;

the cantilever formed by the guide pad and the pad support extends substantially according to the tangential direction;

said first stable configuration corresponds to the first and second longitudinal axes substantially parallel and preferably confounded;

the second stable configuration corresponds to the first and second longitudinal axes inclined in relation to one another by an angle between 5° and 90°, preferably between 30° and 60° and more preferably equal to about 45°.

The invention further relates to an assembly for packaging and applying a cosmetic product, comprising: a cosmetic product applicator as described above, and a container intended to contain said cosmetic product, the applicator and the container comprising a reversible assembly device in a storage configuration, wherein the application element of the applicator is received in an internal volume of the container.

The invention will be easier to understand in view of the following description, provided solely as a non-restricted example and with reference to the drawings, wherein:

FIG. 1 shows a cosmetic product packaging and application assembly 10 according to a first embodiment of the invention. FIG. 2 shows a cosmetic product packaging and application assembly 110 according to a second embodiment of the invention.

Apart from differences detailed hereinafter, the assemblies 10 and 110 are substantially equivalent and will be described simultaneously. The elements common to the assemblies 10 and 110 are designated by the same reference numbers.

The assembly 10, 110 is particularly intended for packaging and applying mascara. The assembly 10, 110 particularly comprises a container 12 and an applicator 14, 114.

Figure 1:
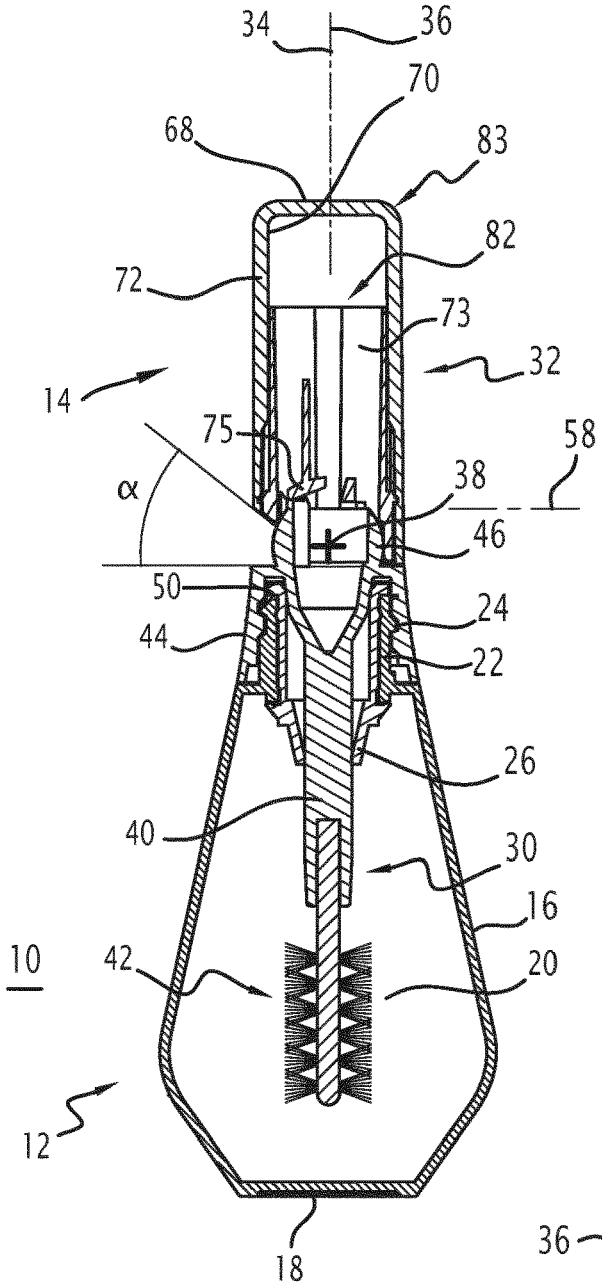
FIG. 1 is a longitudinal cross-section view of a packaging and application assembly according to a first embodiment of the invention, comprising a container and an applicator in a first configuration.
Figure 2:
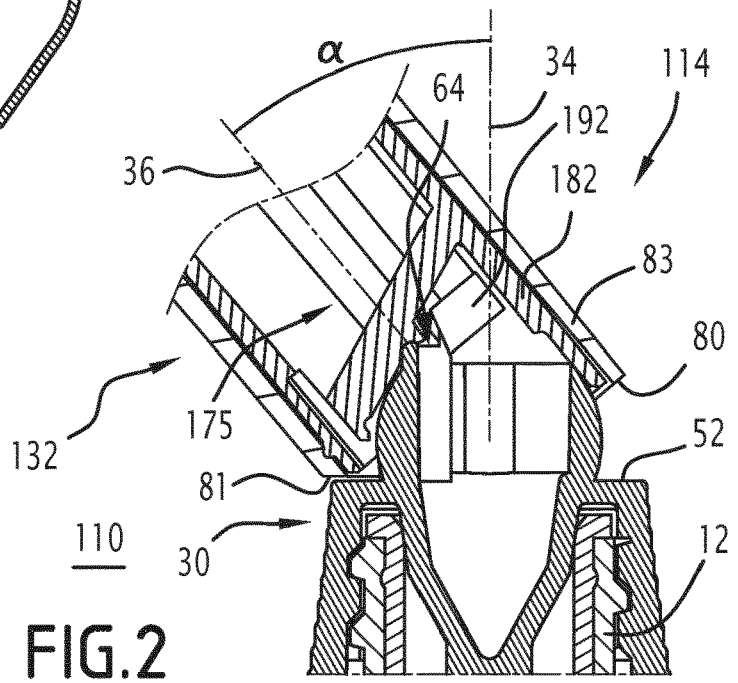
FIG. 2 is a partial longitudinal cross-section view of a packaging and application assembly according to a second embodiment of the invention, comprising an applicator and a container.

The container 12, visible in FIG. 1 and partially shown in FIG. 2, particularly comprises a side wall 16 and a bottom 18, which define an internal volume 20 suitable for receiving a cosmetic product, in particular a liquid mascara type composition.

The container 12 further comprises a neck 22, of tubular shape, wherein an external wall comprises a thread 24.

The container 12 also comprises a squeezing member 26, also of tubular shape, inserted into the neck 22 and extending into the internal volume 20.

The applicator 14, 114 comprises an application member 30 and a gripping member 32, 132, hinged with respect to one another. More specifically, the application 30, 130 and gripping 32, 132 members extend respectively along a first longitudinal axis 34 and along a second longitudinal axis 36; and said application 30 and gripping 32, 132 members are connected by a pivot connection along a third axis, designated hereinafter as axis of rotation 38, perpendicular to the first 34 and second 36 longitudinal axes.

FIG. 1 shows the applicator 14 in a first stable angular configuration, wherein the first 34 and second 36 longitudinal axes are confounded. FIG. 2 shows the applicator 114 in a second stable angular configuration, in which the first 34 and second 36 longitudinal axes are coplanar and inclined by an angle $\alpha$ in relation to one another. The angle $\alpha$ is between 5° and 90°, preferably between 30° and 60°, and more preferably equal to about 45°.

The application member 30, visible in FIG. 1 and partially shown in FIG. 2, comprises: a rod 40 extending along the first longitudinal axis 34; an application head 42, arranged at a first end of the rod; a cap 44 for closing the container 12; a hinge element 46 with the gripping member 32, 132; ad a first guiding element 48. The closing cap 44, the hinge element 46 and the first guiding element 48 are arranged at a second end of the rod 40.

The application head 42 is typically a mascara brush or comb. More particularly, the application head 42 comprises an elongated core, as well as a plurality of reliefs such as bristles or pins, projecting laterally from said core.

Figure 3:
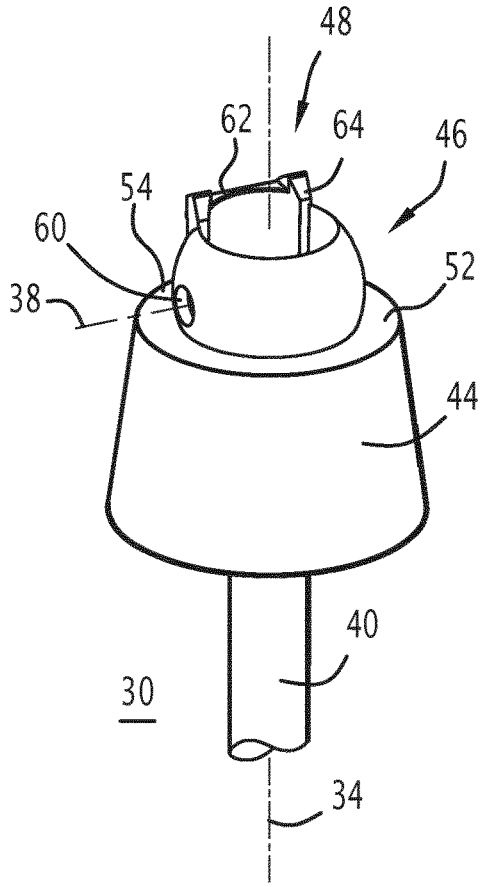
FIG. 3 is a partial view of a first element of the applicator of FIGS. 1 and 2.

FIG. 3 is a detailed view, in perspective, of the application member 30 on the closing cap 44, of the articulation member 46 and of the first guiding element 48.

The closing cap 44 is preferably formed from one piece, or in other words integral, with the second end of the rod 40. Said closing cap has substantially the shape of a ring arranged along the first longitudinal axis 34. An internal surface of said ring comprises an internal thread 50. Said internal thread is suitable for engaging with the thread 24 of the neck 22 to assemble the container 12 and the applicator 14, 114 in a storage configuration, represented in FIGS. 1 and 2. In said storage configuration, the applicator 14, 114 closes the container 12 and the application head 42 is received in the internal volume 20.

According to alternative embodiments not shown, further known devices for assembling the closing cap 44 and the neck 22 are used, such as a snap-locking or other assembly device.

An axial end of the closing cap 44, opposite the application head 42, consists of a ring-shaped surface. It is considered that the surface is formed from a first 52 and a second 54 half-rings, situated on either side of a plane comprising the first longitudinal axis 34 and the third axis, referred to as axis of rotation 38.

In the embodiments of FIGS. 1 to 3, said first 52 and second 54 half-rings are planar, perpendicular to the first longitudinal axis 34 and oriented in the opposite direction to the application head 42. Alternatively, the surface in the shape of a ring can be non-planar and/or non-perpendicular to the first axis.

The hinge element 46 extends the closing cap 44. Said hinge element 46 and closing cap 44 are formed preferably from one piece, or in other words integral.

In the embodiments of FIGS. 1 to 3, the hinge element 46 comprises a rounded body 56, having substantially the shape of a sphere portion comprised between two perpendicular planes to the first longitudinal axis 34. Said two planes are respectively referred to as the proximal plane and distal plane 58 of the hinge element 46. The proximal plane, closest to the application element 42, corresponds to the plane of the first 52 and second 54 half-rings.

The hinge element 46 further includes two circular cavities 60, formed on either side of the rounded body 56. The two circular cavities 60 are suitable for forming a hinge with the gripping member 32, 132 to represent the axis of rotation 38, as described hereinafter.

The first guiding element 48 axially extends the hinge element 46 and is preferably formed from one piece with said hinge element 46.

The first guiding element 48 forms an axial protrusion from the distal plane 58. Said first guiding element 48 comprises a guide rail 62, forming a surface directed outwards with respect to the axis of rotation 38. Said first guiding element 48 further comprises two studs 64, substantially aligned according to a direction parallel to said axis of rotation 38. The studs 64 form a radial protrusion from the guide rail 62, with the term "radial" being understood with respect to the axis of rotation 38.

The gripping member 32, 132 has a substantially tubular shape extending along the second longitudinal axis 36. A distal end 68 of the gripping member 32, 232, furthest from the axis of rotation 38, is preferably closed. The other end, referred to as proximal, is open.

The gripping member 32, 132 comprises an internal side wall 70 and an external side wall 72, arranged about the second longitudinal axis 36. The internal side wall 70 defines a chamber 73 inside the gripping member.

The internal side wall 70 comprises two lugs 74 situated facing one another, in radial projection. The lugs 74 are inserted into the circular cavities 60 of the hinge element 46, said hinge element and the first guiding element 48 being received in the chamber 73. The lugs 74 and the circular cavities 60 thereby form a hinge, materializing the axis of rotation 38 of the gripping member 32, 132 with respect to the application member 30.

The gripping member 32, 132 further comprises a second guiding element 75, 175 that extends in the chamber 73. The second guiding element 75, 175 is able to cooperate with the first guiding element 48 of the application member 30. The second guiding element 75, 175 will be described in detail hereinafter.

In the embodiments of FIGS. 1 and 2, the proximal end of the gripping member 32, 132 is represented by a first 80 and a second 81 edges of the external side wall 72. Said first 80 and second 81 edges are adjacent and substantially arranged on either side of a plane containing the second longitudinal axis 36 and the axis of rotation 38. Each of the first 80 and second 81 edges forms a substantially planar surface. The first edge 80 is substantially perpendicular to the second longitudinal axis 36.

The second edge 81 is formed by a beveled cut in the external side wall 72. More precisely, the second edge 81 is substantially parallel to the axis of rotation 38 and inclined by the angle $\alpha$ with respect to the first edge 80.

In the first stable angular configuration of the applicator 14, 114, as shown in FIG. 1, the first 34 and second 36 longitudinal axes are substantially merged and the first edge 80 of the gripping member 32, 132 is substantially in contact with the first half-ring 52 of the application member 30. In the second stable angular configuration of the applicator 14, 114, as shown in FIG. 2, the first 34 and second 36 longitudinal axes are inclined by an angle $\alpha$ and the second edge 81 of the gripping member 32, 132 is substantially in contact with the second half-ring 54 of the application member 30.

The first and second stable angular configurations described above therefore define the set of possible angular configurations of the gripping member 32, 132 with respect to the application member 30.

The first 48 and second 75, 175 guiding elements have for object to favor the passage of the applicator 14, 114 in one or the other of the first and second stable angular configurations, in opposition with any angular configuration that is unstable, located between said first and second stable configurations.

More precisely, the first 48 and second 75, 175 guiding elements are configured to exert one on the other an elastic radial stress between said first and second stable configurations. The term "radial" is understood with respect to the axis of rotation 38. Each one of the first and second stable configurations corresponds to a minimum of radial elastic stress between said first 48 and second 75, 175 guiding elements.

In the embodiments in FIGS. 1 and 2, the gripping member 32, 132 is formed from an internal sleeve 82, 182 and an external cover 83, inserted and fastened into one another. At the proximal end of the gripping member 32, 132, the internal 70 and external 72 side walls are respectively formed by the sleeve 82, 182 and by the cover 83.

According to an alternative not shown, the internal 70 and external 72 side walls are formed from a single piece.

Figure 4:
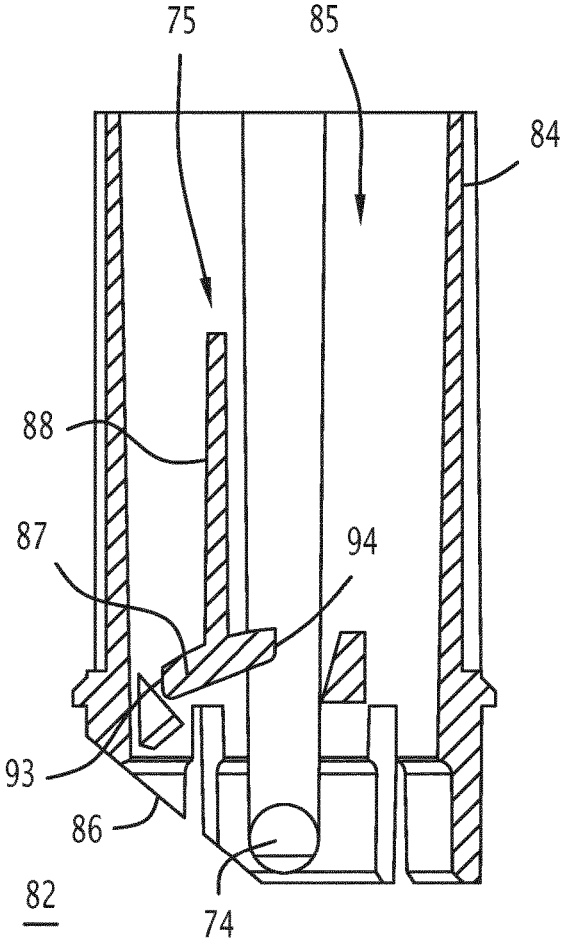
FIGS. 4 and 5 are views of a second element of the applicator of FIG. 1.
Figure 6:
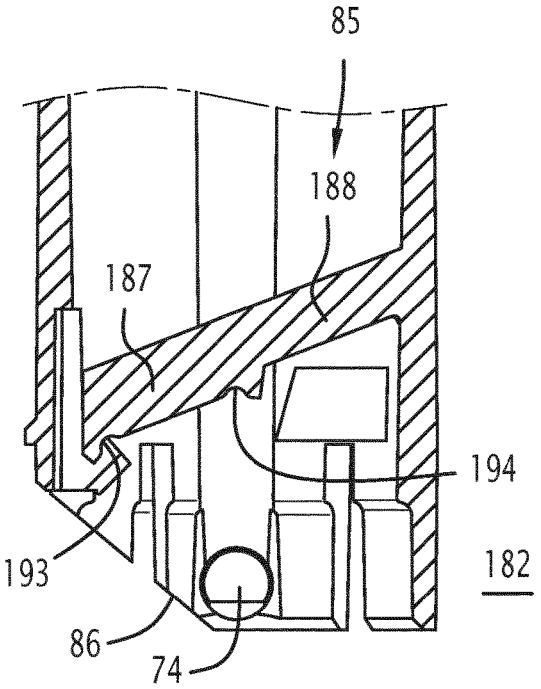
FIGS. 6 and 7 are views of a second element of the applicator of FIG. 2.
Figure 5:
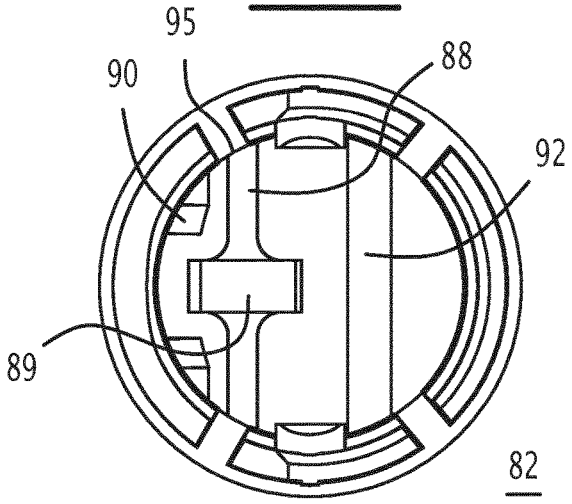
Figure 7:
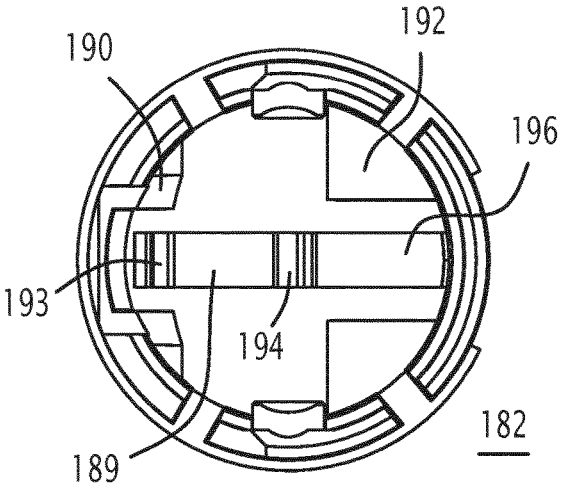

FIGS. 4 and 5 show the internal sleeve 82 of the applicator 14 of FIG. 1, respectively as a longitudinal cross-section and as a bottom view. FIGS. 6 and 7 show the internal sleeve 182 of the applicator 114 of FIG. 2, respectively as a longitudinal cross-section and as a bottom view. The internal sleeves 82 and 182 are described simultaneously hereinbelow:

The internal sleeve 82, 182 comprises a side wall 84, partially forming the internal side wall 70 of the gripping member 32, 132 such as described hereinabove. The side wall 84, is of substantially tubular shape and extends along the second longitudinal axis 36.

The side wall 84 defines an inner recess 85, partially forming the chamber 73 of the gripping member 32, 132 such as described hereinabove. The lugs 74 materializing the axis of rotation 38 form an internal projection from said side wall 84, in said inner recess 85.

At the proximal end, the side wall 84 comprises a beveled cut 86, corresponding to the second edge 81 of the gripping member 32, 132 such as described hereinabove.

The second guiding element 75, 175 is arranged in the inner recess 85. Said second guiding element comprises a guide pad 87, 187 and a pad support 88, 188.

The guide pad 87, 187 has a sliding surface 89, 189, in the form of a strip extending substantially in the tangential direction, i.e. the direction of the rotary displacement of the gripping member 32, 132 with respect to the application member 30. The sliding surface 89, 189 is able to slide against the guide rail 62 of the first guiding element 48 of the application member 30. Parallel to the axis of rotation 38, the sliding surface 89, 189 has a dimension similar to that of said guide rail, in such a way as to take the place between the two studs 64.

The pad support 88, 188 mechanically links the pad 87, 187 to the side wall 84. Said pad support 88, 188, said pad 87, 187 and said side wall 84 are preferably formed from a single piece.

In the embodiments shown in FIGS. 1, 2 and 4-7, the internal sleeve 82, 182 further comprises a first 90, 190 and a second 92, 192 tangential abutments. Said tangential abutments are able to come into contact with the studs 64 of the first guiding element 48 of the application member 30, respectively in the first and in the second angular stable configurations, in such a way as to limit the angular clearance between the application member 30 and the gripping member 32, 132.

In the embodiment of FIGS. 1, 4 and 5, in the tangential direction, the sliding surface 89 is delimited by a first 93 and a second 94 free edges. In the embodiment of FIGS. 2, 6 and 7, in the tangential direction, the sliding surface 189 is delimited by a first 193 and a second 194 notches, able to snap-lock onto the guide rail 62.

In the embodiment of FIGS. 1, 4 and 5, the pad support 88 is substantially planar and arranged parallel to the second 36 and third 38 axes. The two ends 95 of said pad support 88, according to the third axis 38, are integral with the side wall 84. A junction of the pad 87 and of the pad support 88 is located opposite the sliding surface 89.

In the embodiment of FIGS. 2, 6 and 7, the pad support 188 is adjacent to the second notch 194 of the pad 187, extending said pad substantially in the tangential direction. Said pad 187 and pad support 188, of a single piece, form a beam arranged in the inner recess 85, on a slant with respect to the second axis 36. The end 196 of the pad support 188, opposite the second notch 194, is integral with the side wall 84. On the other hand, in the vicinity of the first notch 193, the pad 187 is not mechanically connected to the side wall 84 and forms a cantilever in the second inner recess 85.

A method for using the assembly 10, 110 will now be described. During the application of the mascara using the applicator 14, 114, the application member 30 and the gripping member 32, 132 can be arranged in relation to one another in the first or in the second angular stable configuration.

It is considered that the applicator 14, 114 is in the first angular stable configuration of FIG. 1. The guide rail 62 of the first guiding element 48 of the application member 30 is in contact with the first free edge 93 of the guide pad 87 of the gripping member 32, or alternatively received in the first notch 193 of the guide pad 187 of the gripping member 132.

The user then grasps the closing cap 44 and the external cover 83 and pivots the gripping member 32, 132 with respect to the application member 30, about the axis of rotation 38 by exerting a certain force or torque, for example of about 0.1 N·m, on the gripping element. The putting into contact of the guide rail 62 with the sliding surface 89, 189 causes an elastic deformation of the guide pad 87, 187. The radial stress between the first 48 and second 75, 175 guiding elements is as such increased until it reaches a maximum.

The rotation is continued along an angle $\alpha$, until the second stable angular configuration of FIG. 2, with this rotation being assisted by the progressive reduction/decrease in the elastic stress from the angular position that corresponds to the maximum elastic stress between the first and second guiding elements. The guide rail 62 then comes into contact with the second free edge 94 of the guide pad 87, or is engaged by snap-locking into the second notch 194 of the guide pad 187. The radial stress as such decreases abruptly between the first 48 and second 75, 175 guiding elements. This decrease provides the user with a tactile and/or audible feeling, of the ratchet type, which provides information on the passing of the applicator 14, 114 into the second stable angular configuration.

The reverse rotation, from the second to the first stable angular configuration, unfolds in a similar way. When the guide rail 62 comes into contact with the first free edge 93 of the guide pad 87, or is engaged by snap-locking into the first notch 193 of the guide pad 187, the radial stress as such decreases abruptly, giving a feeling of the ratchet type to the user.

Moreover, in the first stable angular configuration, the first edge 80 of the gripping member 32, 132 is substantially in contact with the first half-ring 52 of the application member 30; likewise, the studs 64 of the application member 30 are in contact with the first tangential abutment 90, 190 of the gripping member 32, 132.

Similarly, in the second stable angular configuration, the second edge 81 of the gripping member 32, 132 is substantially in contact with the second half-ring 54 of the application member 30; likewise, the studs 64 of the application member 30 are in contact with the second tangential abutment 92, 192 of the gripping member 32, 132.

The presence of the first 90, 190 and second 92, 192 tangential abutments authorizes a gap between the first 80 and second 81 edges and, respectively, the first 52 and second 54 half-rings, in the first and second stable angular configurations. In an alternative not shown, the gripping member 32, 132 does not contain any tangential abutments 90, 190, 92, 192, the role of said abutments being solely fulfilled by the edges 80, 81 and the half-rings 52, 54.

In the embodiment of FIGS. 2, 6 and 7, the configuration in cantilever of the guide pad 187 makes it possible to precisely define the radial stress between the first 48 and second 175 guiding elements, by adjusting in particular the thickness of the beam formed by the pad 187 and the pad support 188. As such, it is possible to produce an applicator 114 that can be maneuvered with a single hand by the user between the first and second stable angular configurations, while still avoiding an untimely rotation of the rod during the application of the mascara.

In an alternative to the embodiment shown, the pad 187 is also mechanically connected to the side wall 84 in the vicinity of the first notch 193. Such an alternative makes it possible to rigidify the pad.

According to an embodiment not shown, the first 48 and second 75, 175 guiding elements allow the application member 30 and the gripping member 32, 132 to adopt an intermediate third angular stable configuration, corresponding also to a minimum radial elastic stress. This effect is for example obtained by adding a third notch between the first 193 and second 194 notches of the guide pad 187 of FIGS. 2, 6 and 7. For example, said third notch is substantially located at an equal distance from the first 193 and second 194 notches. A multitude of intermediate angular stable configurations can also be provided between the first and second stable angular configurations of the gripping member with respect to the application member.

The invention claimed is:

1. A cosmetic product applicator, comprising:

an application member extending along a first longitudinal axis, a first end of the application member comprising an application element; a second end of the application member comprising a hinge element, the application member comprising a planar ring-shaped surface consisting of adjacent first and second half-rings, the ring-shaped surface being adjacent to the hinge element; and a gripping member of tubular shape, extending along a second longitudinal axis and hinged to the hinge element of the application member, the tubular shape of the gripping member defining an inner chamber, the hinge element being received in the inner chamber; an end of the gripping member comprising first and second edges, each of the edges forming a substantially planar surface, the second edge being inclined with respect to the first edge at an angle between 5° and 90°;

wherein the gripping member is mobile in rotation with respect to the application member about a third, rotational axis, perpendicular to the first and second longitudinal axes, between a first and a second stable configurations, wherein the first edge of the gripping member is in contact with the first half-ring of the application member in the first stable configuration; and the second edge of the gripping member is in contact with the second half-ring of the application member in the second stable configuration;

wherein the application member and the gripping member respectively comprise a first and a second guiding element, with the first and second guiding elements being configured to slide against one another during the rotation of the gripping member with respect to the application member between the first and second stable configurations, wherein the first and second guiding elements are arranged in the inner chamber of the gripping member, wherein the second guiding element of the gripping member comprises:

a guide pad comprising a sliding surface able to slide against the first guiding element according to a tangential direction, corresponding to a direction of displacement of the gripping member with respect to the application member; and a pad support, integral with both the guide pad and the side wall of the inner chamber of the gripping member, wherein, according to the tangential direction, the sliding surface is delimited by a first and a second notch able to snap-lock onto the first guiding element of the application member, wherein the guide pad and the pad support form a cantilever in the inner chamber of the gripping member.

2. The applicator according to claim 1, wherein the first guiding element of the application member comprises a guide rail, said guide rail being delimited by two studs that are aligned according to a direction parallel to the axis of rotation.

3. The applicator according to claim 1, wherein the cantilever formed by the guide pad and the pad support extends according to the tangential direction.

4. The applicator according to claim 1, wherein the first stable configuration corresponds to the first and second longitudinal axes being parallel.

5. The applicator according to claim 1, wherein the second stable configuration corresponds to the first and second longitudinal axes inclined in relation to one another by an angle ($\alpha$) between 5° and 90°.

6. A cosmetic product packaging and application assembly, comprising:

a cosmetic product applicator according to claim 1, and a container intended to contain the cosmetic product, the applicator and the container comprising a reversible assembly device in a storage configuration, wherein the application element of the applicator is received in an internal volume of the container.

7. The applicator according to claim 1, wherein the first stable configuration corresponds to the first and second longitudinal axes being coincident.

8. The applicator according to claim 2, wherein the first stable configuration corresponds to the first and second longitudinal axes being parallel.

9. The applicator according to claim 2, wherein the first stable configuration corresponds to the first and second longitudinal axes being coincident.

10. The applicator according to claim 3, wherein the first stable configuration corresponds to the first and second longitudinal axes being parallel.

* * * * *